US006581930B2

(12) United States Patent
Kim

(10) Patent No.: US 6,581,930 B2
(45) Date of Patent: Jun. 24, 2003

(54) PAPER SORTING DEVICE FOR AN IMAGE FORMING APPARATUS

(75) Inventor: Kyung-Hwan Kim, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/841,064

(22) Filed: Apr. 25, 2001

(65) Prior Publication Data

US 2002/0084572 A1 Jul. 4, 2002

(30) Foreign Application Priority Data

Dec. 29, 2000 (KR) ..... 2000-86384

(51) Int. Cl.[7] ..... B65H 5/02

(52) U.S. Cl. ..... 271/272; 271/207; 198/458; 198/456; 198/782

(58) Field of Search ..... 271/272, 207; 464/162, 163; 414/791.2; 198/418.8, 456, 458, 782; 399/404

(56) References Cited

U.S. PATENT DOCUMENTS

| | | | | | |
|---|---|---|---|---|---|
| 3,108,458 | A | * | 10/1963 | Springer | 464/162 |
| 3,301,550 | A | * | 1/1967 | Reinecke | 271/272 |
| 4,977,432 | A | * | 12/1990 | Coombs et al. | 399/404 |
| 5,335,904 | A | * | 8/1994 | Ryuzaki | 271/272 |
| 6,241,616 | B1 | * | 6/2001 | Lightcap | 464/162 |

* cited by examiner

*Primary Examiner*—Joseph E. Valenza
(74) *Attorney, Agent, or Firm*—Robert E. Bushnell, Esq.

(57) ABSTRACT

A paper sorting device for an image forming apparatus is capable of sorting printed paper in a zigzag pattern. The paper sorting device for the image forming apparatus has a rotating shaft which is rotated by a driving force from a driving force source, a hollow shaft into which the rotating shaft is slidably inserted so that the hollow shaft rotates with, and is reciprocated on, the rotating shaft, and reciprocating means for reciprocating the hollow shaft. Since printed paper is ejected by the reciprocating movement, the paper is automatically sorted in a zigzag pattern.

16 Claims, 7 Drawing Sheets

PAPER SORTING DEVICE FOR AN IMAGE FORMING APPARATUS

CLAIM OF PRIORITY

This application makes reference to, incorporates the same herein, and claims all benefits accruing under 35 U.S.C. §119 from my application PAPER SORTING DEVICE FOR IMAGE FORMING APPARATUS filed with the Korean Industrial Property Office on Dec. 29, 2000 and there duly assigned Ser. No. 86384/2000.

BACKGROUND OF THE INVENTION

1. Technical Field

The present invention relates to an image forming apparatus such as a laser printer and, more particularly, to a paper sorting device for an image forming apparatus capable of sorting printed paper sheets in a zigzag pattern.

2. Related Art

A laser printer is one of the major image forming devices for printing desired data on paper sheets page by page while being connected to a computer network. Unlike the conventional dot printer or ink jet printer, the laser printer uses an electronic photoprinting method which projects a laser beam onto a charged photosensitive medium to form an electrostatic latent image, develops the electrostatic latent image into a visible image by means of toner particles, and transfers and fixes the visible image on paper.

Typically, a laser printer has a paper cassette, a developing unit, a built-in duplex printing unit, a stacker, and a distributing unit.

In operation, a sheet of paper is picked up from the paper cassette, is fed to and printed in the developing unit, is passed through the distributing unit, and is stacked on the stacker. In duplex printing, paper printed by the developing unit is fed from the distributing unit to the duplex printing unit, and is returned to the developing unit according to a predetermined paper feeding route of the duplex printing unit. A non-printed side of the returned paper is printed by the developing unit, is passed through the distributing unit, and is stacked on the stacker.

In a conventional laser printer, the paper which is printed through a series of processes, as described above, is consecutively stacked on the stacker. Since the paper is consecutively stacked on the same spot in the stacker, a user has to manually sort the paper for distribution, especially when the same image is multi-printed. Manual sorting of the paper causes inconvenience and loss of time to the user.

SUMMARY OF THE INVENTION

The present invention has been developed to solve the above-mentioned problem. Accordingly, it is an object of the present invention to provide a paper sorting device for an image forming apparatus capable of automatic sorting of printed paper sheets in a simple and economical manner.

To accomplish the above object, the paper sorting device of the present invention comprises a rotating shaft rotated by a driving force from a driving force source, a hollow shaft to which the rotating shaft is slidably inserted, the hollow shaft being rotated with the rotating shaft and reciprocated on the rotating shaft, and reciprocating means for reciprocating the hollow shaft.

The hollow shaft has a plurality of guide slits formed in its interior, the rotating shaft has a plurality of rails formed on an outer circumference and corresponding to the guide slits of the rotating shaft, and the hollow shaft is rotated as a result of the rotation of the rotating shaft and is reciprocated on the rotating shaft. The hollow shaft also has a plurality of rollers formed on its outer circumference, the rollers contacting the paper.

The reciprocating means comprises a driving shaft disposed in parallel with the rotating shaft at a predetermined interval for engaging and rotating with the rotating shaft, a guide block connected to one end of the hollow shaft, and also connected to a guide rail on a lower portion thereof, the guide block being reciprocated along the guide rail so as to reciprocate the hollow shaft, a guide cam disposed in the driving shaft and having a guide groove of a certain pattern formed on its outer circumference, a guide lever having one end hinged on an upper portion of the guide block and another end inserted in the guide groove, and a clutch for selectively transmitting the rotating force of the rotating shaft to the driving shaft. The guide groove is formed on the outer circumference of the guide cam and has a helical shape.

The clutch comprises a sector gear disposed around the driving shaft and selectively connected to a driving gear on an upper end of the rotating shaft, a stepping cam disposed around the driving shaft and in parallel with the sector gear, the stepping cam having a stepped portion on an outer circumference thereof, a stopper contacting the stepped portion for restricting rotation of the stepping cam, a solenoid causing the stopper to contact the stepped portion or release the contact, an oval cam disposed around the driving shaft and in parallel with the stepping cam, a lever for pressing and contacting the oval cam, and a spring biasing the lever toward the oval cam.

The paper sorting device further comprises a detector for detecting the left and right positions of the hollow shaft. The detector comprises a photosensor disposed in the image forming apparatus, an eccentric cam disposed around the driving shaft, and a sensing shaft having one end which has a lever in contact with an upper portion of the eccentric cam and another end which has an optic cutoff lever, the optic cutoff lever selectively cutting off light transmitted between a light generating part and a light receiving part of the photosensor by reciprocating with the rotation of the eccentric cam.

According to the present invention, printed paper is ejected by the reciprocating movement of the hollow shaft having rollers, and the paper is automatically sorted in a zigzag pattern.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE PREFERRED EMBODIMENT

Figure 1:
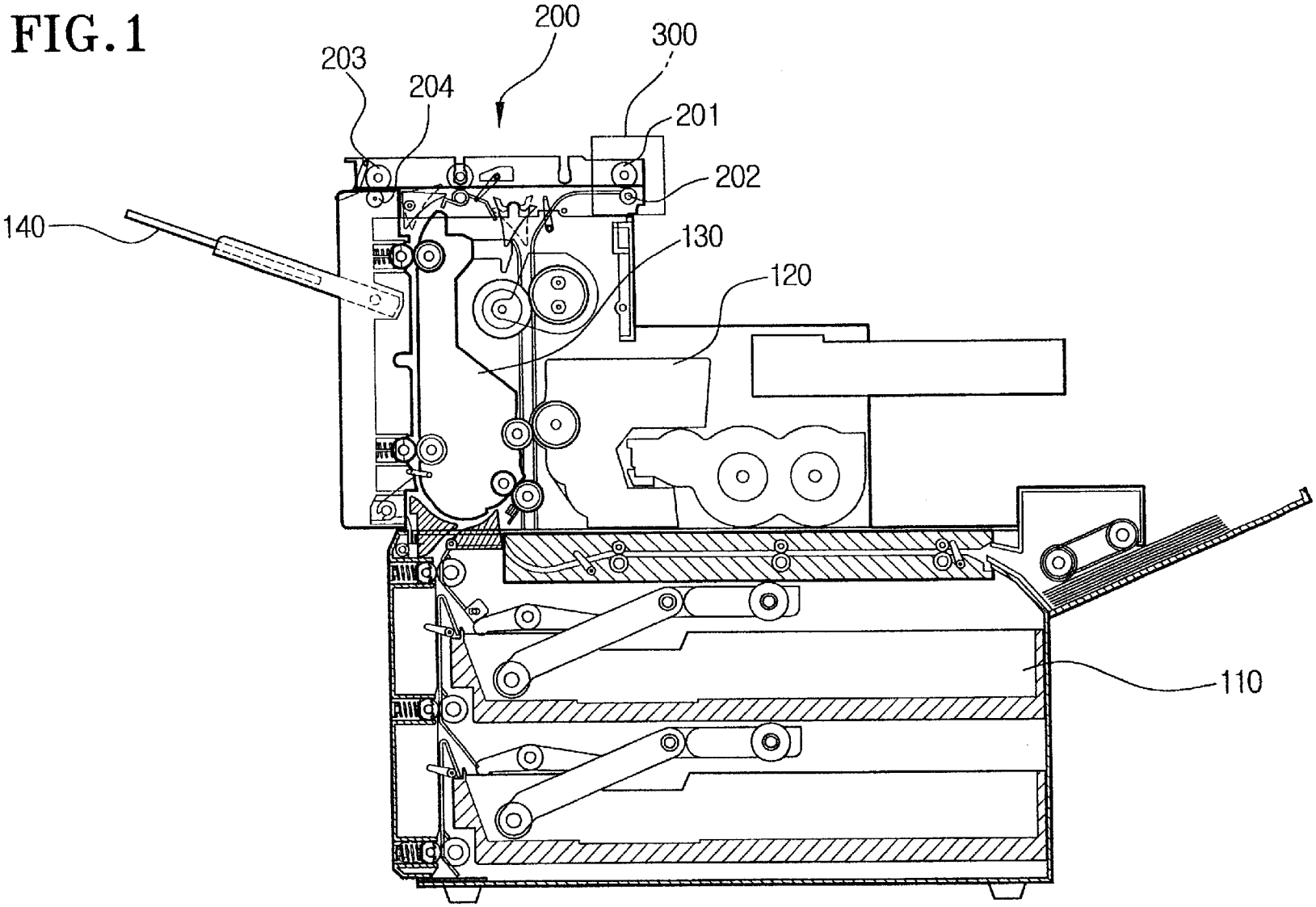
FIG. 1 is a schematic sectional view showing a laser printer having a duplex printing unit.

Referring now in particular to the drawings, the preferred embodiment will be described, wherein like reference characters designate like or corresponding parts throughout, and the details thereof will be omitted where appropriate to save repetition.

FIG. 1 shows a laser printer having a built-in type duplex printing unit. The laser printer includes a paper cassette 110, a developing unit 120, a duplex printing unit 130, a stacker 140, and a distributing unit 200.

In operation, a sheet of paper picked up from the paper cassette 110 is fed to and printed in the developing unit 120, passed through the distributing unit 200, and stacked on the stacker 140. In a duplex printing operation, the paper printed by the developing unit 120 is fed from the distributing unit 200 to the duplex printing unit 130, and returned to the developing unit 120 according to a predetermined paper feeding route of the duplex printing unit 130. A non-printed side of the returned paper is printed by the developing unit 120, passed through the distributing unit 200, and stacked on the stacker 140.

A plurality of conveying rollers 203 and a plurality of backup rollers 204 are disposed in correspondence with each other in the distributing unit 200. The paper is fed according to a predetermined paper distributing route by the rotating force of the conveying rollers 203 and the backup rollers 204. Reference numerals 201 and 202 indicate distributing rollers and backup rollers, respectively, which are capable of normal and reverse rotation according to the direction of paper ejection. The distributing rollers 201 and backup rollers 202 are driven by a motor (not shown). Reference numeral 300 identifies a distributing section disposed opposite the stacker 140.

Figure 2:
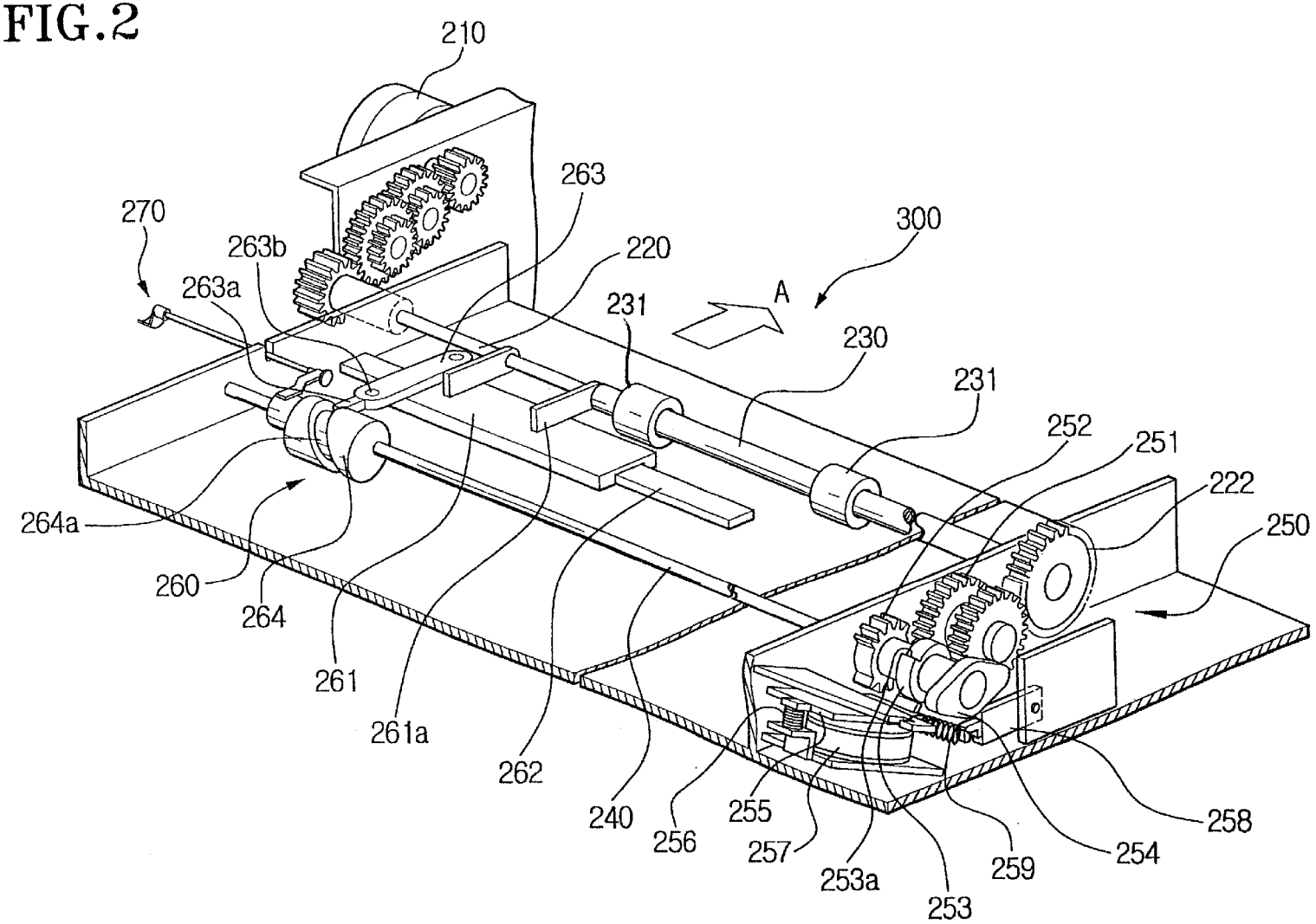
FIG. 2 is a schematic perspective view showing a paper sorting device according to a preferred embodiment of the present invention.

As shown in FIG. 2, a paper sorting device according to the present invention is mounted in the distributing unit 200 of the laser printer shown in FIG. 1. The major components of the paper sorting device are a rotating shaft 220 which is rotated by a force from a driving source, such as a motor 210, a hollow shaft 230 surrounding an outer circumference of the rotating shaft 220, a driving shaft 240 selectively engaging and rotating with the rotating shaft 220, a clutching section 250 selectively connecting the rotating shaft 220 with the driving shaft 240, and a reciprocating section 260 which reciprocates the hollow shaft 230 on the rotating shaft 220 according to the rotation of the driving shaft 240. Reference numeral 270 identifies a detecting section which will be described later, and reference numeral 300 identifies a distributing section disposed opposite the stacker 140, as mentioned above.

A plurality of rotating rollers 231 is disposed on an outer circumference of the hollow shaft 230. The rotating rollers 231 can be the conveying rollers 203 or the distributing rollers 201 of FIG. 1. In this preferred embodiment, the rotating rollers 231 are distributing rollers 201. Although not shown, a plurality of backup rollers is disposed in a lower portion of the rotating rollers 231 for correspondingly engaging the rotating rollers 231.

Figure 3:
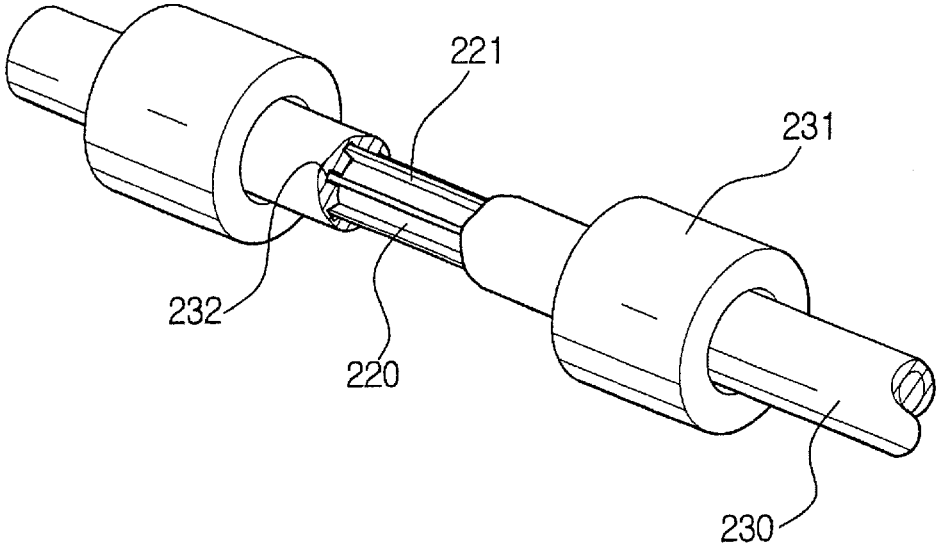
FIG. 3 is a partially cutaway perspective view showing a hollow shaft of FIG. 2.

FIG. 3 is a partially cutaway perspective view showing the hollow shaft 230 while surrounding the rotating shaft 220. A plurality of guide slits 232 are formed in the interior of the hollow shaft 230, and a plurality of rails 221 corresponding to the guide slits 232 are formed on an outer circumference of the rotating shaft 220.

When the rotating shaft 220 is rotated by driving force of the motor 210, the rails 221 and the guide slits 232 are engaged with each other, and thus the hollow shaft 230 is rotated. As the hollow shaft 230 rotates, the rotating rollers 231 engaged with the back up rollers (not shown) rotate, thereby ejecting a printed paper in a paper ejecting direction to the stacker 140. Meanwhile, the hollow shaft 230 is rotated due to rotation of the rotating shaft 220. When the hollow shaft 230 is pushed toward a shaft direction by a guide block 261 (FIG. 2), which will be described later, the rails 221 slide along the guide slits 232. Accordingly, the hollow shaft 230 is reciprocated on the rotating shaft 220.

As shown in FIG. 2, the clutching section 250 has a sector gear 252 disposed around the driving shaft 240 so as to be selectively connected with a driving gear 222 disposed on one end of the rotating shaft 220 through a plurality of idle gears 251. The clutching section 250 also has a stepping cam 253 which is disposed on the driving shaft 240 in parallel with the sector gear 252, and which has a stepped portion 253*a* formed on the outer circumference thereof. The clutching section 250 has an oval cam 254 disposed on the driving shaft 240 in parallel with the stepping cam 253. The driving shaft 240, sector gear 252, stepping cam 253 and oval cam 254 are rotated in mesh with each other.

It is preferable that teeth be formed at 90° intervals on a quarter section of the circumference of the sector gear 252. It is also preferable that two stepped portions 253*a* are formed at a 180° interval on the stepping cam 253.

Meanwhile, in a location of the printer body corresponding to the stepping cam 253, a stopper 255 is movably disposed for restricting rotational movement of the stepping cam 253 by contacting the stepped portion 253*a*. The stopper 255 is biased toward the stepping cam 253 by a first spring 256. A solenoid 257 is disposed in a lower portion of the stopper 255 so as to selectively cause the stopper 255 to contact the stepped portion 253*a* or release the contact according to signals from a controller (not shown). A lever 258 is pivotably disposed in a lower portion of the oval cam 254 for contact with the oval cam 254. The lever 258 is biased toward the oval cam 254 by a second spring 259. Preferably, the first and second springs 256 and 259, respectively, are compressed coil springs.

Figure 4A:
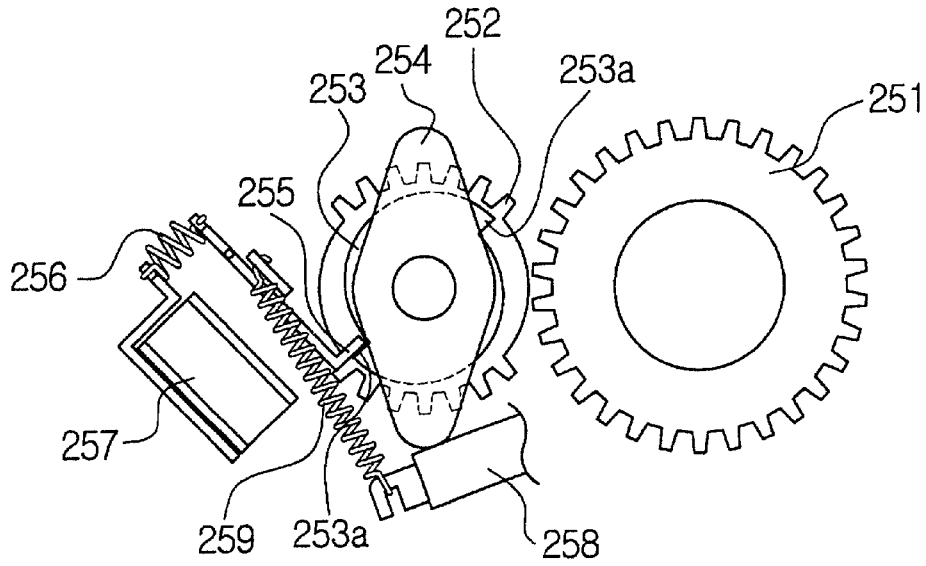
FIGS. 4A and 4B are side views showing a clutching section of FIG. 2.

As shown in FIG. 4A, since rotation of the stepping cam 253 is restricted while the stopper 255 is in contact with the stepped portion 253*a*, and the sector gear 252 is not geared or engaged with the idle gear 251 connected to the rotating shaft 220, the driving shaft 240 does not rotate even though the rotating shaft 220 rotates. The lever 258 is in contact with the oval cam 254 by its longer diameter side, and the second spring 259 is stretched.

Figure 4B:
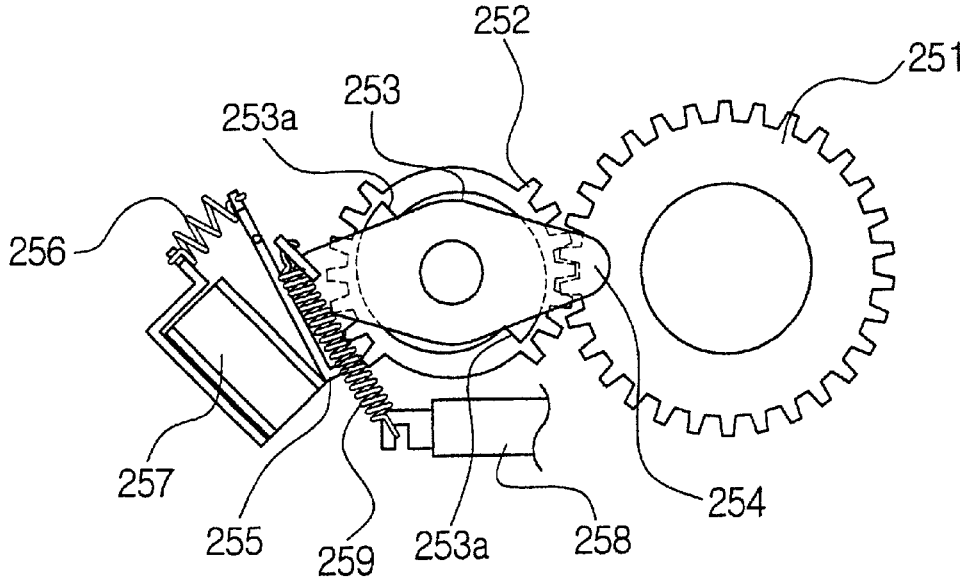

In this state, when power is applied to the solenoid 257, the stopper 255 is moved toward the solenoid 257 by electromagnetic force as shown in FIG. 4B. Since the stopper 255 is released from contact with the stepped portion 253*a*, the restriction of the stepping cam 253 is released, and the first spring 256 is stretched. When the restriction of the stepping cam 253 is released, the second spring 259 is pressed, moving the lever 258 toward the oval cam 254, thereby rotating the oval cam 254. By virtue of rotation of the oval cam 254, the sector gear 252 is rotated and geared with the idle gear 251, so that the driving shaft 240 is rotated according to the rotation of the rotating shaft 220. Since the driving shaft 240 is only rotated in gear with the teeth of the sector gear 252, the driving shaft 240 is rotated by 180°, a quarter (90°) by the initial rotation plus another quarter (90°) by the rotation by the sector gear 252.

Meanwhile, when the power applied to the solenoid 257 is turned off, the stretched first spring 256 is pressed, moving the stopper 255 toward the stepping cam 254, so that the rotation of the driving shaft 240 is stopped by the contact of the stopper 255 with the stepped portion 253*a*.

As shown in FIG. 2, the reciprocating section 260 is connected to one end of the hollow shaft 230, and includes the guide block 261, a guide cam 264, and a guide lever 263. The guide block 261 slides along a guide rail 262 disposed in the printer body. The guide cam 264 is disposed around the driving shaft 240 and has a helical guide groove 264*a* formed on an outer circumference of the guide cam 264. One end of the guide lever 263 is hinged on an upper surface of the guide block 261, while the other end is provided with a guide protrusion 263*a* inserted into the guide groove 264*a*.

The guide lever 263 is disposed in the printer body for pivoting on the pivot center 263*b*, and one end of the hollow shaft 230 is movably connected to a bracket 261*a* formed on the upper surface of the guide block 261. When the guide cam 264 rotates through 360°, the guide lever 263 pivots on the pivot center 263*b* as the guide protrusion 263*a* moves along the guide groove 264*a*, and returns to its initial position.

Figure 5A:
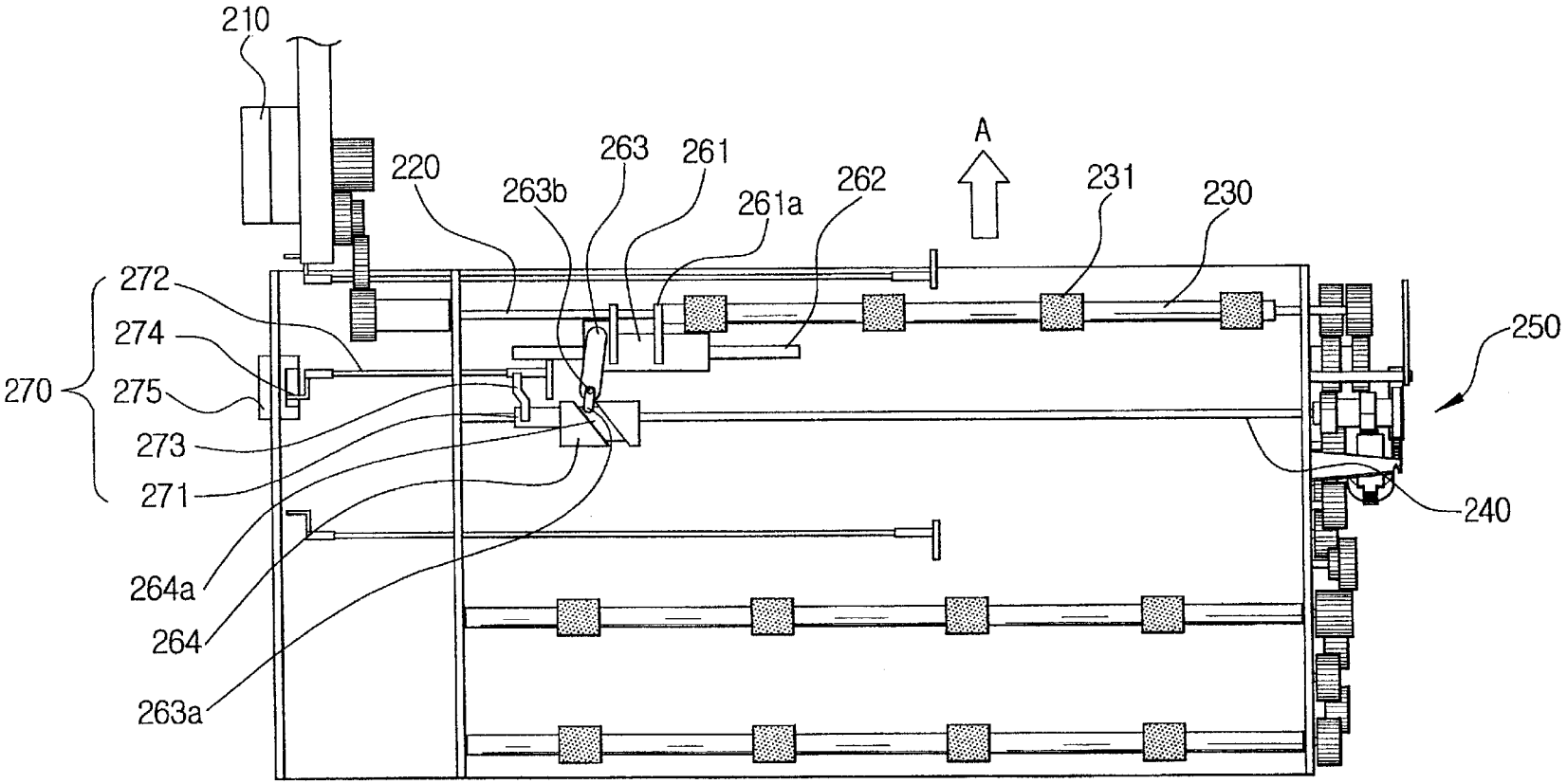
FIGS. 5A and 5B are plan views showing an operation of the paper sorting device of FIG. 2.
Figure 5B:
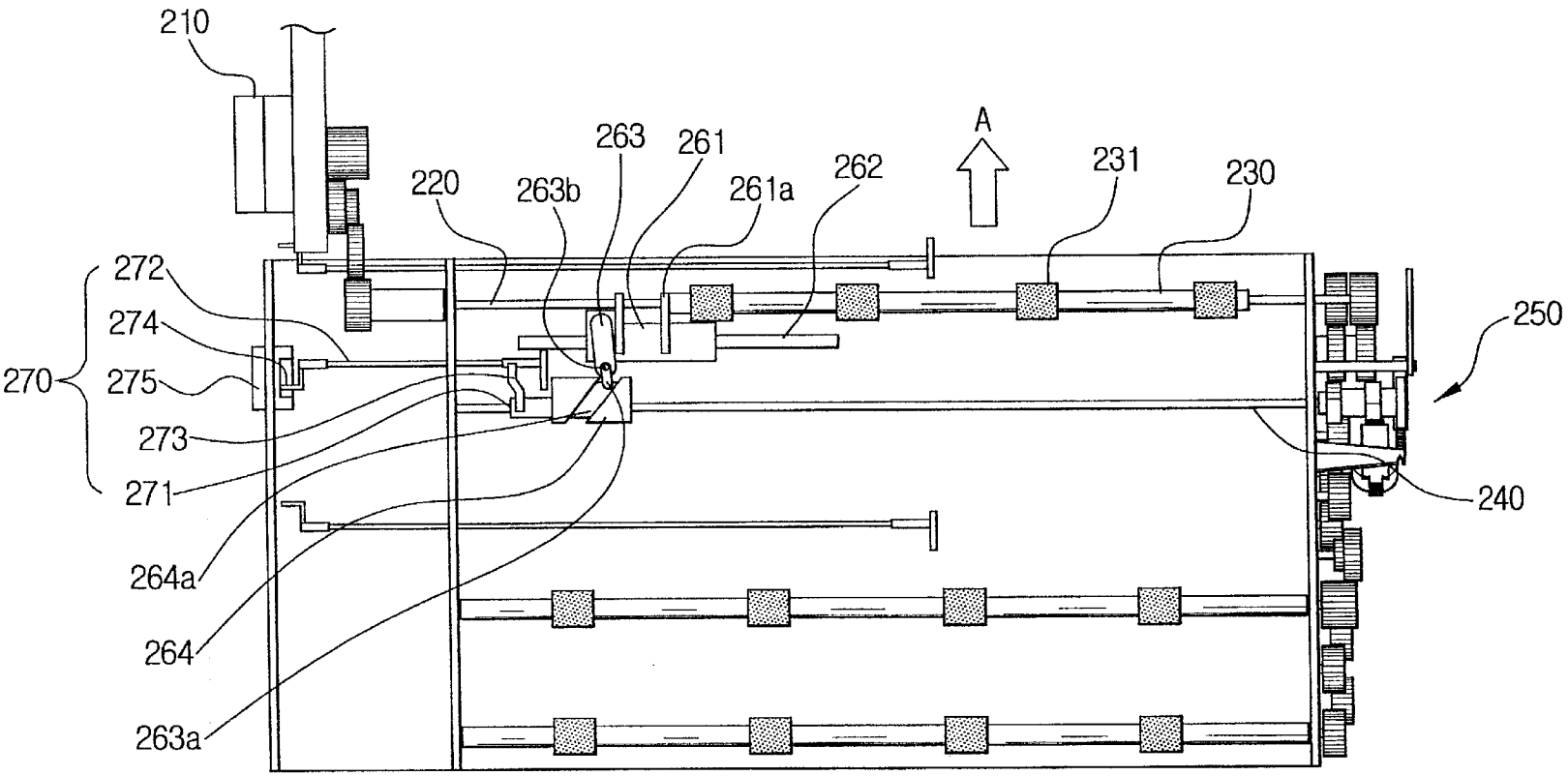

FIGS. 5A and 5B show reciprocating movement of the hollow shaft 230 by the reciprocating section 260 as constructed above.

FIG. 5A shows an initial state when the driving shaft 240 does not rotate. Printed paper is pushed to the right-hand side of FIG. 5A and ejected by the rotating roller 231.

When power is applied to the solenoid 257 (shown in FIG. 4B), the driving shaft 240 is rotated, and thus the guide cam 264 is rotated. Then, the guide lever 263 is moved on the pivot center 263*b* due to rotation of the guide cam 264. As a result of the movement of the guide lever 263, the guide block 261 is moved to the left-hand side of FIG. 5A, and the hollow shaft 230 connected to the bracket 261*a* of the guide block 261 is moved to the left while rotating with the rotating shaft 220.

FIG. 5B shows a state of the driving shaft 240 when rotated by 180°. When the driving shaft 240 is rotated by 180°, the hollow shaft 230 is moved to the left as seen in FIG. 5B, and printed paper is pushed and ejected to the left of the paper eject direction.

In the state shown in FIG. 5B, when power is applied again to the solenoid 257, the driving shaft 240 is rotated by 180°, and the hollow shaft 230 is returned to its initial state seen in FIG. 5A. According to this reciprocal movement of the hollow shaft 230 as described above, printed paper is ejected while being pushed to the left or right so that the printed paper sheets are stacked on the stacker 140 in a zigzag pattern.

Reference numeral 270 identifies a detecting section connected to one end of the driving shaft 240 for detecting the right and left positions of the hollow shaft 230. The detecting section 270 includes a photosensor 275 disposed in the printer body, an eccentric cam 271 connected to the driving shaft 240, and a moving shaft 272 which moves as a result of engagement with the rotation of the eccentric cam 271.

Figure 6:
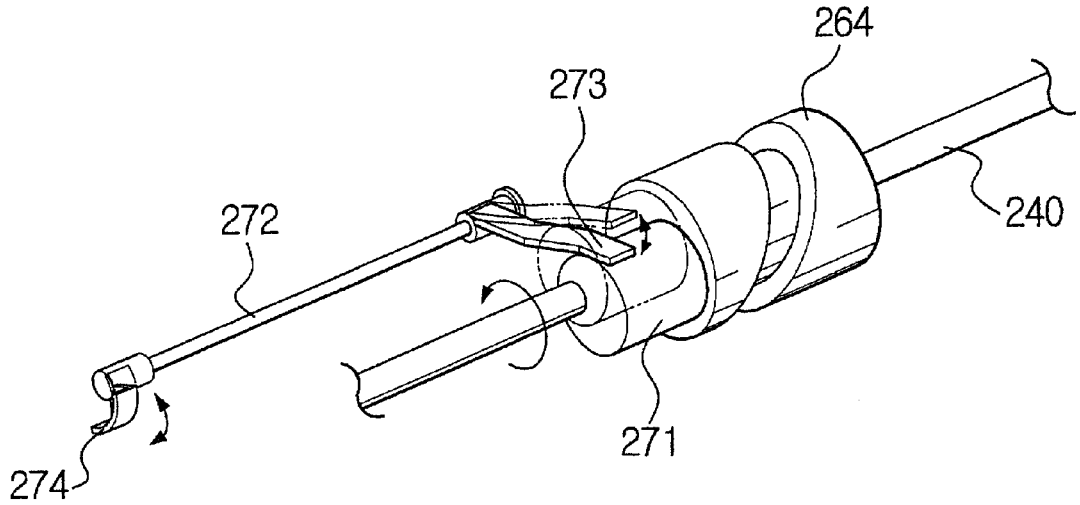
FIG. 6 is a perspective view showing a detecting section of FIG. 2.

As shown in FIG. 6, the eccentric cam 271 is disposed around the driving shaft 240, either integrally with or separately from the guide cam 264. The lever 273 is disposed on one end of the rotating shaft 272, contacting an upper portion of the eccentric cam 271, while an optic cutoff lever 274 is disposed on the other end of rotating shaft 272.

When the eccentric cam 271 is rotated by the rotation of the driving shaft 240, the lever 273 contacting the upper portion of the eccentric cam 271 moves up and down. The optic cutoff lever 274 is moved up and down by the movement of the lever 273 so that light from a light generating part to a light receiving part is selectively cut off by the optic cutoff lever 274.

Accordingly, the photosensor 275 (FIGS. 5A and 5B) detects the right and left positions of the hollow shaft 230 as the light from the light generating part is transferred to or cutoff from the light receiving part. The photosensor 275 outputs to a controller (not shown) signals corresponding to the right and left positions, respectively, of the hollow shaft 230. The controller sequentially controls the solenoid 257 of the clutching section 250 in accordance with the outputted signals of the photosensor 275.

As described above, in the paper sorting device of the image forming apparatus of the present invention, printed paper is pushed to the left or right and ejected by the reciprocating movement of the hollow shaft 230 with the rotating rollers 231. Accordingly, the printed paper sheets can be sorted automatically since the paper sheets are stacked on the stacker 140 in a zigzag pattern, and inconvenient manual sorting by a user is prevented.

Also, since the driving shaft 240 is rotated by the motor driving the rotating shaft 220, an additional motor for sorting the paper becomes unnecessary, and manufacturing cost is minimized as a result.

In the drawings and specification, there have been disclosed typical preferred embodiments of the invention and, although specific terms are employed, they are used in a generic and descriptive sense only and not for purposes of limitation, the scope of the invention being set forth in, and only limited by, the appended claims.

What is claimed is:

1. A paper sorting device for an image forming apparatus, comprising:

a rotating shaft rotated by a driving force from a driving force source;

a hollow shaft into which the rotating shaft is slidably inserted;

contact means operatively associated with said hollow shaft for contacting paper in said paper sorting device;

rotating means operatively associated with said rotating shaft and said hollow shaft for rotating said hollow shaft with, and in response to, rotation of said rotating shaft; and reciprocating means for reciprocating the hollow shaft on the rotating shaft.

2. The paper sorting device as claimed in claim 1, wherein said rotating means comprises a plurality of guide slits formed in an interior of the hollow shaft and a plurality of rails formed on an outer circumference of the rotating shaft in correspondence to the guide slits of the hollow shaft.

3. The paper sorting device as claimed in claim 1, wherein said contact means comprises a plurality of rollers formed on an outer circumference of the hollow shaft for contact with the paper.

4. The paper sorting device as claimed in claim 1, wherein the reciprocating means comprises:

a driving shaft disposed in parallel with the rotating shaft and at a predetermined interval therefrom for engaging and rotating with the rotating shaft;

a guide block connected to one end of the hollow shaft and to a guide rail on a lower portion of the guide block, said guide block being reciprocated along the guide rail for reciprocating the hollow shaft;

a guide cam disposed on the driving shaft and having a guide groove of a certain pattern formed on an outer circumference of the guide cam;

a guide lever having one end hinged on an upper portion of the guide block and another end inserted in the guide groove; and a clutch for selectively transmitting a rotating force of the rotating shaft to the driving shaft.

5. The paper sorting device as claimed in claim 4, wherein the clutch comprises:

a sector gear disposed around the driving shaft and selectively connected to a driving gear disposed on an end of the rotating shaft;

a stepping cam disposed around the driving shaft and in parallel with the sector gear, and having a stepped portion on an outer circumference of the stepping cam;

a stopper which contacts the stepped portion to restrict rotation of the stepping cam;

a solenoid for selectively causing the stopper to selectively contact the stepped portion and release the contact;

an oval cam disposed around the driving shaft and in parallel with the stepping cam;

a lever for pressing and contacting the oval cam; and a spring for biasing the lever toward the oval cam.

6. The paper sorting device as claimed in claim 5, wherein the guide groove is formed on the outer circumference of the guide cam and has a helical shape.

7. The paper sorting device as claimed in claim 4, further comprising detecting means for detecting left and right positions of the hollow shaft.

8. The paper sorting device as claimed in claim 7, wherein the detecting means comprises:

a photosensor;

an eccentric cam disposed around the driving shaft; and a sensing shaft having a lever disposed at one end thereof for contacting an upper portion of the eccentric cam and an optic cutoff lever disposed at another end thereof;

wherein the optic cutoff lever selectively cuts off and passes light transmitted by a light generating part to a light receiving part of the photosensor by reciprocating with rotation of the eccentric cam.

9. The paper sorting device as claimed in claim 1, further comprising detecting means for detecting left and right positions of the hollow shaft.

10. The paper sorting device as claimed in claim 9, wherein said reciprocating means comprises a driving shaft disposed in parallel with the rotating shaft for engaging and rotating with the rotating shaft, and wherein said detecting means comprises:

a photosensor;

an eccentric cam disposed around the driving shaft; and a sensing shaft having a lever disposed at one end thereof for contacting an upper portion of the eccentric cam and an optic cutoff lever disposed at another end thereof;

wherein the optic cutoff lever selectively cuts off and passes light transmitted by a light generating part to a light receiving part of the photosensor by reciprocating with rotation of the eccentric cam.

11. The paper sorting device as claimed in claim 1, wherein said reciprocating means comprises a driving shaft disposed in parallel with the rotating shaft for engaging and rotating with the rotating shaft, and wherein said reciprocating means further comprises a clutch for selectively transmitting a rotating force of the rotating shaft to the driving shaft.

12. The paper sorting device as claimed in claim 11, wherein the clutch comprises:

a sector gear disposed around the driving shaft and selectively connected to a driving gear disposed on an end of the rotating shaft;

a stepping cam disposed around the driving shaft and in parallel with the sector gear, and having a stepped portion on an outer circumference of the stepping cam;

a stopper which contacts the stepped portion to restrict rotation of the stepping cam;

a solenoid for selectively causing the stopper to selectively contact the stepped portion and release the contact;

an oval cam disposed around the driving shaft and in parallel with the stepping cam;

a lever for pressing and contacting the oval cam; and a spring for biasing the lever toward the oval cam.

13. The paper sorting device as claimed in claim 12, wherein the guide groove is formed on the outer circumference of the guide cam and has a helical shape.

14. The paper sorting device as claimed in claim 11, further comprising detecting means for detecting left and right positions of the hollow shaft.

15. The paper sorting device as claimed in claim 14, wherein the detecting means comprises:

a photosensor;

an eccentric cam disposed around the driving shaft; and a sensing shaft having a lever disposed at one end thereof for contacting an upper portion of the eccentric cam and an optic cutoff lever disposed at another end thereof;

wherein the optic cutoff lever selectively cuts off and passes light transmitted by a light generating part to a light receiving part of the photosensor by reciprocating with rotation of the eccentric cam.

16. The paper sorting device as claimed in claim 1, wherein paper printed in said image forming apparatus is ejected by reciprocating movement of the hollow shaft on the rotating shaft, whereby the printed paper is automatically sorted in a zigzag pattern.

* * * * *